US009878568B2

(12) United States Patent
Singh

(10) Patent No.: US 9,878,568 B2
(45) Date of Patent: Jan. 30, 2018

(54) LOW BASIS WEIGHT INKJET PRINTABLE SUBSTRATES WITH LOWER SHOWTHROUGH AND IMPROVED WATERFASTNESS AND PRINT DENSITY

(71) Applicant: INTERNATIONAL PAPER COMPANY, Memphis, TN (US)

(72) Inventor: Kapil M. Singh, West Chester, OH (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 179 days.

(21) Appl. No.: 14/870,591

(22) Filed: Sep. 30, 2015

(65) Prior Publication Data

US 2017/0087912 A1 Mar. 30, 2017

(51) Int. Cl.

| | |
|---|---|
| ***B41M 5/00*** | (2006.01) |
| ***B41M 5/50*** | (2006.01) |
| ***B41M 5/52*** | (2006.01) |
| *B05D 1/00* | (2006.01) |

(52) U.S. Cl.

CPC ..... *B41M 5/508* (2013.01); *B41M 5/5218* (2013.01); *B41M 5/5227* (2013.01); *B41M 5/5236* (2013.01); *B41M 5/5245* (2013.01); *B05D 1/00* (2013.01)

(58) Field of Classification Search

CPC .. B41M 5/508; B41M 5/5218; B41M 5/5245; B05D 1/00

See application file for complete search history.

(56) References Cited

U.S. PATENT DOCUMENTS

| | | | | |
|---|---|---|---|---|
| 4,554,181 | A | 11/1985 | Cousin et al. | |
| 5,672,392 | A | 9/1997 | De Clereq et al. | |
| 6,207,258 | B1 | 3/2001 | Varnell | |
| 6,475,601 | B1 | 11/2002 | Sakaki et al. | |
| 8,454,797 | B1 | 6/2013 | Veverka et al. | |
| 8,758,886 | B2 | 6/2014 | Koenig et al. | |
| 2003/0227531 | A1* | 12/2003 | Hosoi | B41M 5/508 347/105 |

(Continued)

FOREIGN PATENT DOCUMENTS

WO 2013176682 11/2013

*Primary Examiner* — Betelhem Shewareged
(74) *Attorney, Agent, or Firm* — Thomas W. Barnes, III

(57) ABSTRACT

An article in the form of a printable substrate having a showthrough value of about 0.14 or less, and an opacity value of at least about 88% which includes a paper substrate with a first and second surfaces formed of paper fibers having a basis weight of from about 12 to about 32 lbs/1300 $ft^2$, and a substrate filler in an amount in the range of from 0 to about 30% by weight of the paper substrate; and a surface size layer on at least one of the first and second surfaces, the surface size layer having about 50 lbs or less per ton of the paper substrate of a starch surface sizing agent and a multivalent metal salt drying agent in an amount sufficient to impart to the at least one of the first and second surfaces a black print density value of at least about 0.8 when inkjet printed with pigmented inks and a waterfastness value of at least about 85% when inkjet printed with dye-based inks, the printable substrate having a MD tensile strength of at least about 12 lbs/in. and a CD tensile strength of at least about 6 lbs/in. Also, a method for preparing such a printable substrate.

36 Claims, 8 Drawing Sheets

(56) References Cited

U.S. PATENT DOCUMENTS

| | | | | |
|---|---|---|---|---|
| 2004/0001963 | A1* | 1/2004 | Watanabe | D21H 19/36<br>428/514 |
| 2012/0082846 | A1* | 4/2012 | Song | C08L 3/02<br>428/342 |

* cited by examiner

LOW BASIS WEIGHT INKJET PRINTABLE SUBSTRATES WITH LOWER SHOWTHROUGH AND IMPROVED WATERFASTNESS AND PRINT DENSITY

FIELD OF THE INVENTION

The present invention broadly relates to printable substrates comprising paper substrates having low basis weights with one or more the surface size layers thereof having minimized amounts of starch surface sizing agent for lower showthrough, as well as sufficient amounts of multivalent metal salt drying agents to provide improved waterfastness when inkjet printed with dye-based inks, as well as black print density when inkjet printed with pigmented inks. The present invention further broadly relates a method for preparing such printable substrates.

BACKGROUND

In conventional calendered papermaking for providing paper substrates (e.g., paper sheets) used in printing, a fibrous web may be prepared from an aqueous solids mixture which may comprise wood pulp and/or synthetic paper fibers along with various additives such as sizing agents, binders, fillers, pigments, etc. Sizing agents are used primarily to prevent excess penetration, wicking, spreading, resistance to blotting etc., of water or ink, and especially internal absorption of the water or ink by the resulting paper substrate. Such sizing agents may include "internal sizing" agents in which the sizing agent (e.g., an alkyl ketene dimer, an alkenyl succinic anhydride, etc.) is included, added, etc., during the papermaking process before a fibrous paper substrate is formed, as well as "surface sizing" agents (e.g., starch, styrene maleic anhydride copolymers, styrene acrylates, etc.) in which the sizing agent is applied on, added to, etc., the surface of formed fibrous paper substrate. The sized paper substrate may exhibit improved properties in terms of, for example, print density, because more of the dye or pigment present in the ink remains on the surface of the paper substrate, rather than being absorbed internally by the paper substrate.

In recent years, the use of ink jet printing methods has been increasing at a rapid rate. Inkjet printing is a method for forming ink images on a paper substrate from deposited droplets of ink comprising dyes or pigments. This printing method enables high-speed and full-color printing to be achieved. In inkjet printing, the fine droplets of ink are sprayed or jetted from printing nozzles at a high speed so as to direct the ink droplets toward, and deposit these droplets on, the paper substrate to provide printed images on the paper substrate. The ink used in inkjet printing may contain either dyes or pigments as print agents. In the case of inks comprising pigments, the ink may also be in the form of a pigment emulsion.

Printed articles such as documents, books, direct mail advertising, etc., may be created by using web fed, higher speed inkjet printers. Examples of such higher speed inkjet printers may include, for example, Canon ColorStream 3000 printers, Ricoh InfoPrint 5000 printers, HP Pagewide Web Press T300, etc. Higher speed inkjet printers may be used to print such articles from paper substrates to save cost versus prior printing methods such as offset printing, laser printing, etc. To achieve such lower costs, customers may want to use low basis weight, lower cost printable paper substrates to create such printed articles when using inkjet printers, yet retain the desirable properties of higher basis weight, more expensive printable paper substrates, such as reduced or minimized showthrough. Showthrough is the phenomenon where the paper substrate may be printed on both sides, but becomes difficult to read on either side due to the print on one side "showing through" to the other side of the printed sheet.

SUMMARY

According to a first broad aspect of the present invention, there is provided an article comprising an printable substrate having a showthrough value of about 0.14 or less, and an opacity value of at least about 88%, the printable substrate comprising:

- a paper substrate having a first surface and a second surface, a basis weight of from about 12 to about 32 lbs/1300 $ft^2$, the paper substrate comprising:
  - paper fibers in an amount in the range of from about 60 to 100% by weight of the paper substrate; and
  - a substrate filler in an amount in the range of from 0 to about 30% by weight of the paper substrate; and
- a surface size layer on at least one of the first and second surfaces, the surface size layer comprising:
  - about 50 lbs or less per ton of the paper substrate of a starch surface sizing agent; and
  - a multivalent metal salt drying agent in an amount sufficient to impart to the at least one of the first and second surfaces a black print density value of at least about 0.8 when inkjet printed with pigmented inks and a waterfastness value of at least about 85% when inkjet printed with dye-based inks;
  - wherein the printable substrate has a MD tensile strength of at least about 12 lbs/in. and a CD tensile strength of at least about 6 lbs/in.

According to a second broad aspect of the present invention, there is provided a method for preparing a printable substrate, which comprises the following steps:

(a) providing a paper substrate having a first surface and a second surface, a basis weight of from about 12 to about 32 lbs/1300 $ft^2$, the paper substrate comprising:
  - paper fibers in an amount in the range of from about 60 to 100% by weight of the paper substrate; and
  - a substrate filler in the range of from 0 to about 30% by weight of the paper substrate; and (b) forming on at least one of the first and second surfaces a surface size layer to provide the printable substrate having a showthrough value of about 0.14 or less, and an opacity value of at least about 88%;

(c) wherein the surface size layer of step (b) comprises about 50 lbs or less per ton of the paper substrate of a starch surface sizing agent;

(d) wherein the surface size layer of step (b) comprises a multivalent metal salt drying agent in an amount sufficient to impart to the at least one of the first and second surfaces a black print density value of at least about 0.8 when inkjet printed with pigmented inks and a waterfastness value of at least about 85% when inkjet printed with dye-based inks;

(e) wherein the printable substrate of step (b) has a MD tensile strength of at least about 12 lbs/in. and a CD tensile strength of at least about 6 lbs/in.

BRIEF DESCRIPTION OF THE DRAWINGS

The invention will be described in conjunction with the accompanying drawings, in which.

DETAILED DESCRIPTION

Figure 1:
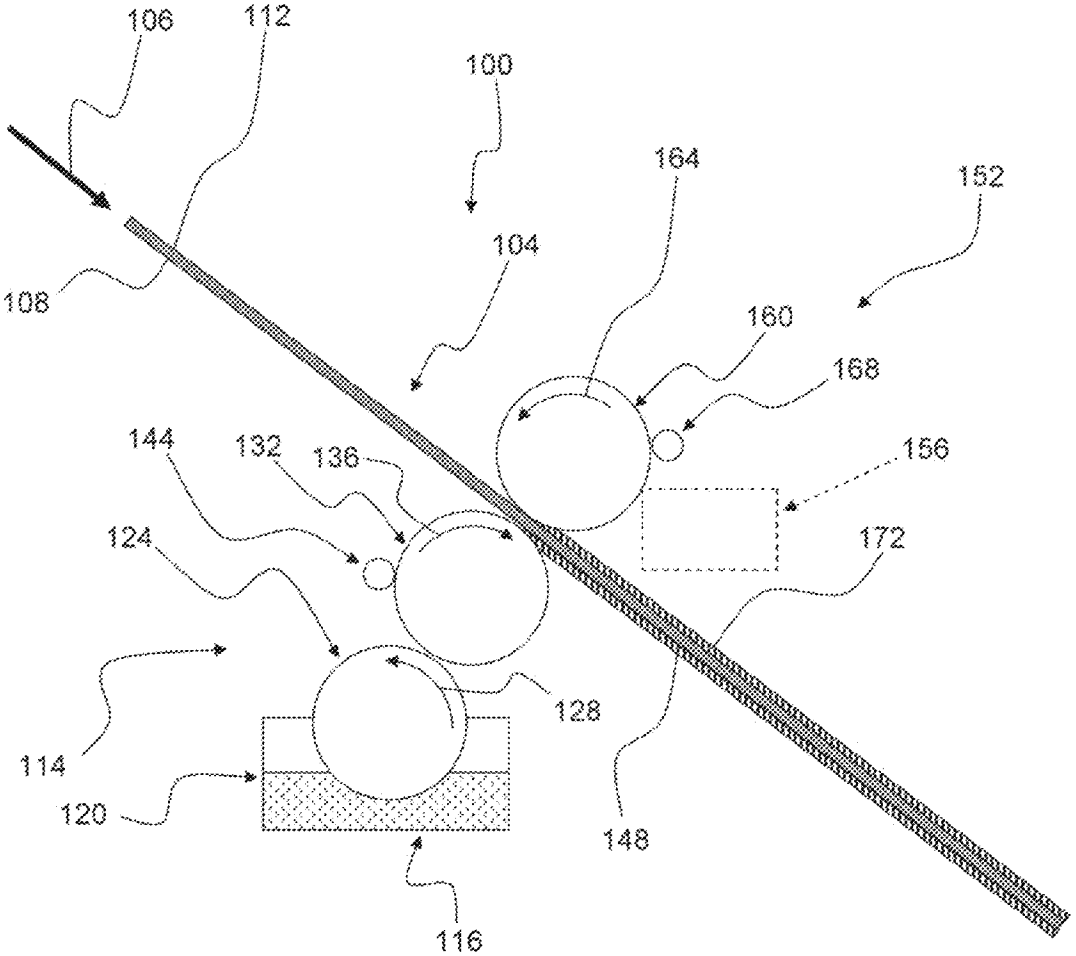
FIG. 1 a schematic diagram illustrating an embodiment of a method for treating one or both surfaces of a paper substrate with a surface size composition comprising a divalent metal salt drying agent using a metering rod size press and optionally a [starch sizing agent]

It is advantageous to define several terms before describing the invention. It should be appreciated that the following definitions are used throughout this application.

Definitions

Where the definition of terms departs from the commonly used meaning of the term, applicant intends to utilize the definitions provided below, unless specifically indicated.

For the purposes of the present invention, directional terms such as "top," "bottom," "side," "front," "frontal," "forward," "rear," "rearward," "back," "trailing," "above", "below", "left", "right", "horizontal", "vertical", "upward", "downward", etc. are merely used for convenience in describing the various embodiments of the present invention. The embodiments of the present invention may be oriented in various ways.

For the purposes of the present invention, the term "printable substrate" refers to any paper substrate which may be printed on with an inkjet printing process. Printable substrates may include webs, sheets, strips, etc., may be in the form of a continuous roll, a discrete sheet, etc.

For the purposes of the present invention, the term "paper substrate" refers to a fibrous web that may be formed, created, produced, etc., from a mixture, furnish, etc., comprising paper fibers, internal paper sizing agents, etc., plus any other optional papermaking additives such as, for example, fillers, wet-strength agents, optical brightening agents (or fluorescent whitening agent), etc. The paper substrate may be in the form of a continuous roll, a discrete sheet, etc.

For the purposes of the present invention, the term "paper fibers" refers to any fibrous material which may be used in preparing a fibrous paper web. Paper making fibers may include pulp (wood) fibers (e.g., softwood fibers and/or hardwood fibers), kraft fibers (e.g., pulp fibers produced by the kraft pulping process), as well as wood fibers produced by soda, sulfite, magnefite, cold soda, NSSC, etc., pulp making processes, synthetic fibers, waste paper fibers, recycled paper fibers, fibers from any of hemp, jute, ramie, flax, cotton linters, abaca, wood waste, straw, bagasse, bamboo, sisal, synthetic (e.g., bicomponent) fibers, etc., as well as any combinations of such fibers.

For the purposes of the present invention, the term "softwood fibers" refers to fibrous pulps derived from the woody substance of coniferous trees (gymnosperms) such as varieties of fir, spruce, pine, etc., for example, loblolly pine, slash pine, Colorado spruce, balsam fir, Douglas fir, jack pine, radiata pine, white spruce, lodgepole pine, redwood, etc. North American southern softwoods and northern softwoods may be used to provide softwood fibers, as well as softwoods from other regions of the world. Inclusion of softwood fibers tends to impart greater bending stiffness in paper substrates, but also tends to impart rougher and less smooth surfaces in paper substrates, such as those comprising kraft paper fibers.

For the purposes of the present invention, the term "hardwood fibers" refers to fibrous pulps derived from the woody substance of deciduous trees (angiosperms) such as birch, oak, beech, maple, eucalyptus, poplars, etc. Inclusion of hardwood fibers in paper substrates tends to impart smoother surfaces in paper substrates.

For the purposes of the present invention, the term "bleached fibers" refers to paper fibers which have been subjected to a bleaching process to, for example, increase the brightness, whiteness, etc., of the paper substrate prepared from such fibers. Bleaching of paper fibers may be carried by using bleaching agents which may include one or more of: chlorine; hypochlorite; chlorine dioxide; oxygen; hydrogen peroxide; ozone, etc.

For the purposes of the present invention, the term "CTMP fibers" refers to chemithermomechanical pulp (CTMP) fibers which have subjected to a combination of chemical, thermal, and mechanical treatment. As used herein, CTMP fibers refer to fibers which have been treated by chemical, thermal, and mechanical treatment in any order of such treatments, including chemi-thermo-mechanical (C-T-M) pulp fibers, thermo-chemi-mechanical (T-C-M) pulp fibers, thermo-mechanical-chemi (T-M-P) pulp fibers, long fiber chemi-mechanical pulp/chemically treated long pulp fibers (LFCMP/CTLF), etc. See G. A. Smook, Handbook for Pulp and Paper Technologists ($2^{nd}$ Edition, 1992), pages 60-65, the entire contents and disclosure of which is herein incorporated by reference, for a general description of chemithermomechanical pulping (CTMP) for preparing CTMP fibers.

For the purposes of the present invention, the term "bleached CTMP fibers (also referred to interchangeably as BCTMP fibers" refers to chemithermomechanical pulp (CTMP) fibers which have subjected to one or more bleaching treatments.

For the purposes of the present invention, the term "synthetic fibers" refers to fibers other than wood pulp fibers (e.g., other than pulp fibers) and which may be made from, for example, cellulose acetate, acrylic, polyamides (such as, for example, Nylon 6, Nylon 6/6, Nylon 12, polyaspartic acid, polyglutamic acid, etc.), polyamines, polyimides, polyamides, polyacrylics (such as, for example, polyacrylamide, polyacrylonitrile, esters of methacrylic acid and acrylic acid, etc.), polycarbonates (such as, for example, polybisphenol A carbonate, polypropylene carbonate, etc.), polydienes (such as, for example, polybutadiene, polyisoprene, polynorbomene, etc.), polyepoxides, polyesters (such as, for example, polyethylene terephthalate, polybutylene terephthalate, polytrimethylene terephthalate, polycaprolactone, polyglycolide, polylactide, polyhydroxybutyrate, polyhydroxyvalerate, polyethylene adipate, polybutylene adipate, polypropylene succinate, etc.), polyethers (such as, for example, polyethylene glycol(polyethylene oxide), polybutylene glycol, polypropylene oxide, polyoxymethylene (paraformaldehyde), polytetramethylene ether(polytetrahydrofuran), polyepichlorohydrin, and so forth), polyfluorocarbons, formaldehyde polymers (such as, for example, urea-formaldehyde, melamine-formaldehyde, phenol formaldehyde, etc.), polyolefins (such as, for example, polyethylene, polypropylene, polybutylene, polybutene, polyoctene, etc.), polyphenylenes (such as, for example, polyphenylene oxide, polyphenylene sulfide, polyphenylene ether sulfone, etc.), silicon containing polymers (such as, for example, polydimethyl siloxane, polycarbomethyl silane, etc.), polyurethanes, polyvinyls (such as, for example, polyvinyl butyral, polyvinyl alcohol, esters and ethers of polyvinyl alcohol, polyvinyl acetate, polystyrene, polymethylstyrene, polyvinyl chloride, polyvinyl pyrrolidone, polymethyl vinyl ether, polyethyl vinyl ether, polyvinyl methyl ketone, etc.), polyacetals, polyarylates, and copolymers (such as, for example, polyethylene-co-vinyl acetate, polyethylene-co-acrylic acid, polybutylene terephthalate-co-polyethylene terephthalate, polylauryllactam-block-polytetrahydrofuran, vinyl chloride, regenerated cellulose such as viscose rayon, glass fibers, ceramic fibers, bicomponent fibers, melamine fibers (e.g., fibers obtained from melamine-formaldehyde resin), etc.

For the purposes of the present invention, the term "bicomponent fibers" refers to synthetic fibers comprising a core and sheath configuration. The core and sheath portions of these bicomponent fibers may be made from various polymers. For example, bicomponent fibers may comprise a PE (polyethylene) or modified PE sheath which may have a PET (polyethylene terephthalate) or PP (polypropylene) core. In one embodiment, the bicomponent fiber may have a core made of polyester and sheath made of polyethylene. Alternatively, a multi-component fiber with a PP (polypropylene) or modified PP or PE sheath or a combination of PP and modified PE as the sheath or a copolyester sheath wherein the copolyester is isophthalic acid modified PET (polyethylene terephthalate) with a PET or PP core, or a PP sheath-PET core and PE sheath-PP core and co-PET sheath fibers may be employed. Various geometric configurations may be used for the bicomponent fiber, including concentric, eccentric, islands-in-the-sea, side-by-side, etc. The relative weight percentages and/or proportions of the core and sheath portions of the bicomponent fiber may also be varied.

For the purposes of the present invention, the term "basis weight" refers to the weight per unit area of a sheet, roll, etc., of material comprising the paper substrate, with or without layers or coatings, as determined by TAPPI test T410. See G. A. Smook, Handbook for Pulp and Paper Technologists ($2^{nd}$ Edition, 1992), page 342, Table 22-11, the entire contents and disclosure of which is herein incorporated by reference, which describes the physical test for measuring basis weight. The basis weight of the paper substrate is essentially a measure of the weight of that paper substrate per unit area, herein reflected in units of lbs/1300 $ft^2$. Suitable basis weights for use herein are from about 12 to about 32 lbs/1300 $ft^2$, such as from about 15 to about 25 lbs/1300 $ft^2$ (e.g., from about 18 to about 20 lbs/1300 $ft^2$).

For the purposes of the present invention, the term "substrate filler" refers to inorganic materials, which may be in particulate form, which may lower the cost (per weight) of the paper substrate, etc. Substrate fillers (e.g., paper fillers) which may used in embodiments of the present invention may include, for example, calcium carbonate, magnesium carbonate, calcium hydroxide, calcium aluminate, magnesium carbonate mica, silica, alumina, sand, gravel, sandstone, limestone, crushed rock, bauxite, granite, limestone, glass beads, aerogels, xerogels, fly ash, fumed silica, fused silica, tabular alumina, clay, (e.g., kaolin clay), talc, microspheres, hollow glass spheres, porous ceramic spheres, ceramic materials, pozzolanic materials, zirconium compounds, xonotlite (a crystalline calcium silicate gel), lightweight expanded clays, perlite, vermiculite, hydrated or unhydrated hydraulic cement particles, pumice, zeolites, exfoliated rock, etc., and mixtures thereof. Certain substrate fillers, such as calcium carbonate, clay, talc, etc., may also function as substrate pigments.

For the purposes of the present invention, the term "substrate pigments" refers to mineral pigments (e.g., calcium carbonate, clay (e.g., kaolin clay), talc, etc.), as well as non-mineral materials (e.g., plastic pigments, etc.), which may be used in paper making to reduce materials cost per unit mass of the paper substrate, increase opacity, increase smoothness, etc. The mineral pigments may be finely divided, for example, in the size range of from about 0.5 to about 5 microns, may be platy mineral pigments, etc.

For the purposes of the present invention, the term "calcium carbonate" refers various calcium carbonates which may be used as substrate pigments, such as precipitated calcium carbonate (PCC), ground calcium carbonate (GCC), modified PCC and/or GCC, etc.

For the purposes of the present invention, the term "precipitated calcium carbonate (PCC)" refers to a calcium carbonate which may be manufactured by a precipitation reaction and which may be used as a substrate (paper) pigment. PCC may comprise almost entirely of the calcite crystal form of $CaCO_3$. The calcite crystal may have several different macroscopic shapes depending on the conditions of production. Precipitated calcium carbonates may be prepared by the carbonation, with carbon dioxide ($CO_2$) gas, of an aqueous slurry of calcium hydroxide ("milk of lime"). The starting material for obtaining PCC may comprise limestone, but may also be calcined (i.e., heated to drive off $CO_2$), thus producing burnt lime, CaO. Water may added to "slake" the lime, with the resulting "milk of lime," a suspension of $Ca(OH)_2$, being then exposed to bubbles of $CO_2$ gas. Cool temperatures during addition of the $CO_2$ tend to produce rhombohedral (blocky) PCC particles. Warmer temperatures during addition of the $CO_2$ tend to produce scalenohedral (rosette-shaped) PCC particles. In either case, the end the reaction occurs at an optimum pH where the milk of lime has been effectively converted to $CaCO_3$, and before the concentration of $CO_2$ becomes high enough to acidify the suspension and cause some of it to redissolve. In cases where the PCC is not continuously agitated or stored for many days, it may be necessary to add more than a trace of such anionic dispersants as polyphosphates. Wet PCC may have a weak cationic colloidal charge. By contrast, dried PCC may be similar to most ground $CaCO_3$ products in having a negative charge, depending on whether dispersants have been used. The calcium carbonate may be precipitated from an aqueous solution in three different crystal forms: the vaterite form which is thermodynamically unstable, the calcite form which is the most stable and the most abundant in nature, and the aragonite form which is metastable under normal ambient conditions of temperature and pressure, but which may convert to calcite at elevated temperatures. The aragonite form has an orthorhombic shape that crystallizes as long, thin needles that may be either aggregated or unaggregated. The calcite form may exist in several different shapes of which the most commonly found are the rhombohedral shape having crystals that may be either aggregated or unaggregated and the scalenohedral shape having crystals that are generally unaggregated.

For the purposes of the present invention, the term "recyclable" refers to compositions, compounds, substances, materials, paper substrates, etc., which may be reused as is or after reprocessing (e.g., composting, other chemical processing, etc.) in preparing new compositions, compounds, substances, materials, paper substrates, etc. The term "recyclable" includes the term "repulpable."

For the purposes of the present invention, the term "repulpable" refers to compositions, compounds, substances, materials, paper substrates, etc., which may be reused as is or after reprocessing (e.g., composting, other chemical processing, etc.) in papermaking.

For the purposes of the present invention, the term "surface size composition" refers to those compositions (e.g., size press compositions), which comprise, at minimum, a multivalent metal salt drying agent, etc. These surface size compositions may also include other optional additives, such as, for example, surface sizing agents, substrate pigments, cationic dye fixing agents, optical brightening agents (OBAs), monovalent metal salts, solvents, diluents, anti-scratch and mar resistance agents, etc. The surface size composition may be formulated as an aqueous solution, an aqueous slurry, a colloidal suspension, a liquid mixture, a thixotropic mixture, etc.

For the purposes of the present invention, the term "tensile strength" refers to a stress as measured per unit area of a printable substrate. The tensile strength of a printable substrate may be measured in the machine direction (MD) and/or cross-machine (CD) direction of the printable substrate by using TAPPI method T-494, in units of, for example, lbs per inch (lbs/in.).

For the purposes of the present invention, the term "MD" refers to machine direction of the printable substrate, i.e., is used in the conventional papermaking sense of the direction the printable substrate moved during its formation. A sufficient degree of MD tensile strength permits, for example, the printable substrate to advanced (pulled) through printing and converting equipment, especially after any perforation in the printable substrate is made in the cross-machine (CD) direction.

For the purposes of the present invention, the term "CD" refers to the cross-machine direction, i.e., is used in the conventional papermaking sense of the direction transverse (e.g., orthogonal) to the machine direction (MD). A sufficient degree of CD tensile strength permits, for example, proper folding of the printable substrate and handling thereof paper, i.e., avoid having the printable substrate crumple up because it is too flimsy.

For the purposes of the present invention, the term "solids basis" refers to the weight percentage of each of the respective solid materials (e.g., multivalent metal salt drying agent; calcium carbonate pigment component; a cationic dye fixing agent; plastic pigment, surface sizing agent, etc.) present in the surface size composition, layer, etc., in the absence of any liquids (e.g., water). Unless otherwise specified, all percentages given herein for the solid materials are on a solids basis.

For the purposes of the present invention, the term "solids content" refers to the percentage of non-volatile, non-liquid components (by weight) that are present in the composition, etc.

For the purposes of the present invention, the term "substantially free" refers to a surface size composition, layer, etc., having less than about 0.1% of a particular component by weight of the surface size composition, layer, etc.

For the purposes of the present invention, the term "cationic starch binder" refers to a agent for binding or fixing substrate fillers and/or substrate pigments and which comprises starch, a starch derivative, etc., and which has been modified to make the starch binder cationic. Suitable cationic starch binders may be derived from a natural starch, e.g., natural starch obtained from a known plant source, for example, wheat, maize, potato, tapioca, etc. Theses starches may be chemically treated to render these starches cationic to provide the cationic starch binder. Suitable commercially available cationic starch binders include Sta-Lok 330 (Tate & Lyle), etc.

For the purposes of the present invention, the term "multivalent metal salt drying agent agents" refers to those metal salt drying agents which may improve the dry time of inks deposited or printed on printable substrates by ink jet printing processes. These multivalent metal salt drying agents may comprise one or more multivalent metal drying salts.

For the purposes of the present invention, the term "multivalent metal drying salt" refers to those metal drying salts wherein the cationic moiety has a positive charge of two or more (e.g., a calcium cation, a magnesium cation, an aluminum cation, etc.) such as calcium salts, magnesium salts, aluminum salts, etc., and which are water soluble. The counter anions for these multivalent metal drying salts may include, for example, chloride, bromide, acetate, bicarbonate, sulfate, sulfite, nitrate, hydroxide, silicate, chlorohydrate, etc. Suitable multivalent metal drying salts (e.g., divalent salts, trivalent salts, etc.) may include one or more of calcium chloride, calcium acetate, calcium hydroxide, calcium nitrate, calcium sulfate, calcium sulfite, magnesium chloride, magnesium acetate, magnesium nitrate, magnesium sulfate, magnesium sulfite, aluminum chloride, aluminum nitrate, aluminum sulfate, aluminum chlorohydrate, sodium aluminum sulfate, vanadium chloride, etc.

For the purposes of the present invention, the term "cationic dye fixing agent" refers to those cationic compounds (e.g., nitrogen-containing compounds) or mixtures of such compounds which may aid in fixing, trapping, etc, inks printed by inkjet printing processes, and which may provide other properties, including waterfastness. These cationic dye fixing agents may include compounds, oligomers and polymers which contain one or more quaternary ammonium functional groups, and may include cationic water-soluble polymers that are capable of forming a complex with anionic dyes. Such functional groups may vary widely and may include substituted and unsubstituted amines, imines, amides, urethanes, quaternary ammonium groups, dicyandiamides, guanadines, biguanides, etc. Illustrative of such compounds are polyamines, polyethyleneimines, polymers or copolymers of diallyldimethyl ammonium chloride (DADMAC), copolymers of vinyl pyrrolidone (VP) with quaternized diethylaminoethylmethacrylate (DEAMEMA), polyamides, polyhexamethylene biguanide (PHMB), cationic polyurethane latexes, cationic polyvinyl alcohols, polyalkylamines dicyandiamid copolymers, amine glycidyl addition polymers, poly[oxyethylene (dimethyliminio) ethylene (dimethyliminio) ethylene] dichlorides, etc., or combinations thereof. These cationic dye fixing agents may include low to medium molecular weight cationic polymers and oligomers having a molecular equal to or less than 100,000, for example, equal to or less than about 50,000, e.g., from about 10,000 to about 50,000. Illustrative of such materials are polyalkylamine dicyandiamide copolymers, poly[oxyethylene(dimethyliminio ethylene(dimethyliminio-ethylene] dichlorides and polyamines having molecular weights within the desired range. Cationic dye fixing agents suitable herein may include low molecular weight cationic polymers such as polyalkylamine dicyandiamid copolymer, poly[oxyethylene (dimethyliminio)ethylene(dimethyliminio)ethylene] dichloride, for example, low molecular weight polyalkylamine dicyandiamid copolymers. See U.S. Pat. No. 6,764,726 (Yang et al.), issued Jul. 20, 2004, the entire disclosure and contents of which is hereby incorporated by reference.

For the purposes of the present invention, the term "opacity" refers to the ability of a paper substrate to hide things such as print images on subsequent sheets or printed on the back, e.g., to minimize, prevent, etc., showthrough, etc. As used herein, opacity of the paper substrate may be measured by, for example, in terms of TAPPI opacity. TAPPI opacity may be measured by T425 om-91.

For the purposes of the present invention, the term "print quality" refers to those factors, features, characteristics, etc., that may influence, affect, control, etc., the appearance, look, form, etc., of a printed image on the printable substrate. Print quality of a printable substrate may be measured in terms of, for example, one or more of: (1) print density; (2) showthrough; (3) waterfastness; (4) dry times; (5); print contrast; (6) edge acuity; etc. For the purposes of the present invention, print quality of the printable substrate is primarily determined herein by measuring the waterfastness, showthrough, and print density of the printable substrate.

For the purposes of the present invention, the term "waterfastness" (also referred to interchangeably as "water fastness") refers to the propensity of print to persist on the paper, and not wash out of paper, when exposed to water. From print density, one may calculate water fastness of a printable substrate by using the following equation: (OD of soaked ink area/OD of unsoaked ink area)×100=% waterfastness. The soaked area is soaked completely in water for one minute, pulled out, and then dried. The printable substrates useful herein may have a waterfastness of at least about 85%, such as at least about 90% (e.g., greater than about 95%), which may include any and all ranges and subranges therein.

For the purposes of the present invention, the term "showthrough" (also known as "show-through") refers to the degree to which printing on one side of a paper sheet may be seen through the other side of the same sheet. Showthrough may correlate to opacity of the paper, the degree of ink penetration into the paper, etc. Values for showthrough may be determined by the Showthrough Test Methodology, which is described below.

For the purposes of the present invention, the term "print density" refers to the optical density ("OD") measured by using a reflectance densitometer (X-Rite, Macbeth. Etc.) which measures the light absorbing property of an image printed on a paper sheet. For example, the higher the print density, the darker the print image may appear. Higher print densities also provide a higher contrast, a sharper image for viewing, etc. Print density is measured herein in terms of the black print density (i.e., the print density of images which are black in color). The method for measuring black print density involves printing a solid block (about 1 inch ×1 inch in size) of black color on a paper sheet, and then measuring the optical density. The printer used to print the solid block of black color on the paper sheet is an HP Officejet Pro 8100, manufactured by Hewlett-Packard, (or its equivalent) which uses a #950 (HP product number CNO49AN#140) black ink jet cartridge (or its equivalent). The default setting of Plain Paper type and Normal print quality print mode is used in printing the solid block of pigmented black ink on the paper sheet. Similarly, an Epson Stylus C88+printer is used to print solid black dye-based ink blocks, using Epson High Speed Dye-Based Inkjet Inks. An X-Rite model 528 spectrodensitometer with a 6 mm aperture may be used to measure the optical density of the solid block of pigmented ink black color printed on the printable paper sheet to provide black print density values. The black print density measurement settings used are Visual color, status T, and absolute density mode. In general, black print density ("$OD_O$") values for black pigmented inks may be determined by using a standard (plain paper, normal) print mode for an HP desktop ink jet printer (or its equivalent), and when using the most common black pigmented ink (a #950 ink jet cartridge or its equivalent). See also commonly assigned U.S. Pat. No. 8,758,886 (Koenig et al.), issued Jun. 24, 2014, the entire disclosure and contents of which is herein incorporated by reference, which describes how to carry out this black print density test.

For the purposes of the present invention, the term "dry time" refers to the time it takes for deposited ink to dry on the surface of a printable substrate. If the deposited ink does not dry quickly enough, this deposited ink may transfer to other printable substrate sheets, which is undesirable. The percentage of ink transferred ("IT %") is recorded as a measure of the dry time. The higher the amount of the percentage of ink transferred, the slower (worse) the dry time. Conversely, the lower the amount of the percentage of ink transferred, faster (better) the dry time. In general, embodiments of the printable substrates of the present invention provide a percent ink transferred ("IT %") value equal to or less than about 65%. In some embodiments of the printable substrates of the present invention, the IT % value may be equal to or less than about 50%, for example, equal to or less than about 40% (e.g., equal to or less than about 30%.

For the purposes of the present invention, the term "ink transfer" refers to a test for determining the dry time of a printable substrate, for example, printable paper sheets. "Ink transfer" is defined herein as the amount of optical density transferred after rolling with a roller, and is expressed as a percentage of the optical density transferred to the unprinted portion of the printable substrate (e.g., paper sheet) after rolling with a roller. The method involves printing solid colored blocks on a printable paper substrate having a basis weight of 20 lbs/1300 ft.$^2$, waiting for a fixed amount of time, 5 seconds after printing, and then folding in half so that the printed portion contacts an unprinted portion of the printable paper substrate, and rolling with a 4.5 lb hand roller as for example roller item number HR-100 from Chem Instruments, Inc., Mentor, Ohio, USA. The optical density is read on the transferred ($OD_T$), the non-transferred ($OD_O$) portions of the block, and an un-imaged area ($OD_B$) by a reflectance densitometer (X-Rite, Macbeth. Etc.). The percent transferred ("IT %") is defined as IT %=$[(OD_T-OD_B)/(OD_O-OD_B)]\times100$. See also commonly assigned U.S. Pat.

No. 7,651,744 (Koenig et al.), issued Jan. 26, 2010, the entire disclosure and contents of which is herein incorporated by reference, which describes how to carry out the ink transfer test.

For the purposes of the present invention, the term "edge acuity (EA)" refers to the degree of sharpness (or raggedness) of the edge of a printed image (e.g., a printed line). Edge acuity (EA) may be measured by an instrument such as the QEA Personal Image Analysis System (Quality Engineering Associates, Burlington, Mass.), the QEA Scanner-IAS, or the ImageXpert KDY camera-based system. All of these instruments collect a magnified digital image of the sample and calculate an EA value by image analysis. The EA value (also known as "edge raggedness") is defined in ISO method 13660. This method involves printing a solid line 1.27 mm or more in length, and sampling at a resolution of at least 600 dpi. The instrument calculates the location of the edge based on the darkness of each pixel near the line edges. The edge threshold may be defined as the point of 60% transition from the substrate reflectance factor (light area, $R_{max}$) to the image reflectance factor (dark area, $R_{max}$) using the equation $R_{60}=R_{max}-60\%\ (R_{max}-R_{min})$. The edge raggedness may then be defined as the standard deviation of the residuals from a line fitted to the edge threshold of the line, calculated perpendicular to the fitted line. For embodiments of printable substrates of the present invention, the EA value may be less than about 15, for example, less than about 12, such as less than about 10 (e.g., less than about 8). See also commonly assigned U.S. Pat. No. 7,651,744 (Koenig et al.), issued Jan. 26, 2010, the entire disclosure and contents of which is herein incorporated by reference, which describes how to measure edge acuity (EA) values.

For the purposes of the present invention, the term "calendering" refers to a conventional papermaking process for smoothing out the surface of the material being calendered, e.g., a printable substrate. For example, calendering may involve a process of using pressure (and optionally temperature and moisture) for smoothing out a rougher surface. Calendering may be carried out on a calender which may comprise a series of calender rolls at the end of, for example, a papermaking machine (on-line), or separate from the papermaking machine (off-line). Calendering may include supercalendering, hot-soft calendering, moisture-gradient calendering, extended nit calendering, belt calendering, etc. See G. A. Smook, Handbook for Pulp and Paper Technologists ($2^{nd}$ Edition, 1992), pages 273-78, the entire contents and disclosure of which is herein incorporated by reference, for a general description of calendering, as well as devices for carrying out calendering, that may be useful herein.

For the purposes of the present invention, the term "substrate smoothness" refers to the extent to which the substrate surface deviates from a planar or substantially planar surface, as affected by the depth of the substrate, substrate width, numbers of departure from that planar surface, etc. As used herein, the substrate smoothness of a printable substrate may be measured by, for example, in terms of Parker Print Smoothness. Parker Print Smoothness may be measured by TAPPI test method T 555 om-99.

For the purposes of the present invention, the term "digital printing" refers to reproducing, forming, creating, providing, etc., digital images on a printable substrate, for example, a paper sheet. Digital printing may include laser printing, ink jet printing, etc.

For the purposes of the present invention, the term "laser printing" refers to a digital printing technology, method, device, etc., that may use a laser beam to create, form produce, etc., a latent image on, for example, photoconductor drum. The light of laser beam may later create charge on the drum which may then pick up toner which carries an opposite charge. This toner may then be transferred to the printable substrate and the resulting print image created, formed, produced, etc., fused to the printable substrate through, for example, a fuser.

For the purposes of the present invention, the term "electrophotographic recording process" refers to a process which records images on a printable substrate, such as a paper sheet, by xerography or electrophotography. In an electrophotographic process, the image is often formed on of the c by toner particles which are deposited one surface or side of the printable substrate, and are then thermally fixed and/or fused to that one surface or side of the printable substrate, for example, by heating. In electrophotographic recording, the printable substrate may have two relatively smooth or flat sides or surfaces, or may have one side or surface which is textured, uneven or nonsmooth/nonflat, while the other side or surface is relatively smooth or flat.

For the purposes of the present invention, the term "inkjet printing" refers to a digital printing technology, method, device, etc., that may form images on a printable substrate by spraying, jetting, etc., tiny droplets of liquid inks onto the printable substrate through the printer nozzles. The size (e.g., smaller size), precise placement, etc., of the ink droplets may provide higher quality inkjet prints. Inkjet printing may include continuous inkjet printing, drop-on-demand inkjet printing, etc.

For the purposes of the present invention, the term "liquid" refers to a non-gaseous fluid composition, compound, material, etc., which may be readily flowable at the temperature of use (e.g., room temperature) with little or no tendency to disperse and with a relatively high compressibility.

For the purpose of the present invention, the term "printer" refers to any device which prints an image on a printable substrate, such as a paper sheet, including laser printers, inkjet printers, electrophotographic recording devices (e.g., copiers), scanners, fax machines, etc.

For the purpose of the present invention, the term "printer pigment" may refer to either ink (as used by, for example, an inkjet printer, etc.) and toner (as used by, for example, a laser printer, electrographic recording device, etc.).

For the purpose of the present invention, the term "ink" refers printer pigment as used by ink jet printers. The term ink may include dye-based inks and/or pigment-based inks Dye-based inks comprise a dye which may be an organic molecule which is soluble in the ink medium. Dye-based inks may be classified by their usage, such as acid dyes, basic dyes, or direct dyes, or by their chemical structure, such as azo dyes, which are based on the based on an —N═N— azo structure; diazonium dyes, based on diazonium salts; quinone-imine dyes, which are derivates of quinine, etc. Pigment-based inks comprise a pigment, which is a solid colored particle suspended in the ink medium. The particle may comprise a colored mineral, a precipitated dye, a precipitated dye which is attached to a carrier particle, etc. Inks are often dispensed, deposited, sprayed, etc., on a printable medium in the form of droplets which then dry on the printable medium to form the print image(s).

For the purpose of the present invention, the term "toner" refers printer pigment as used by laser printers. Toner is often dispensed, deposited, etc., on the printable medium in the form of particles, with the particles then being fused on the printable medium to form the image.

For the purposes of the present invention, the term "coater" refers to a device, equipment, machine, etc., which may be used to treat, apply, coat, etc., surface size compositions to one or more sides or surfaces of a paper substrate, for example, just after the paper substrate has been dried for the first time. Coaters may include air-knife coaters, rod coaters, blade coaters, size presses, etc. See G. A. Smook, Handbook for Pulp and Paper Technologists ($2^{nd}$ Edition, 1992), pages 289-92, the entire contents and disclosure of which is herein incorporated by reference, for a general description of coaters that may be useful herein. Size presses may include a puddle size press, a metering size press, etc. See G. A. Smook, Handbook for Pulp and Paper Technologists ($2^{nd}$ Edition, 1992), pages 283-85, the entire contents and disclosure of which is herein incorporated by reference, for a general description of size presses that may be useful herein.

For the purposes of the present invention, the term "flooded nip size press" refers to a size press having a flooded nip (pond), also referred to as a "puddle size press." Flooded nip size presses may include vertical size presses, horizontal size presses, etc.

For the purposes of the present invention, the term "metering size press" refers to a size press that includes a component for spreading, metering, etc., deposited, applied, etc., a surface size composition on a paper substrate side or surface. Metering size presses may include a rod metering size press, a gated roll metering size press, a doctor blade metering size press, etc.

For the purposes of the present invention, the term "rod metering size press" refers to metering size press that uses a rod to spread, meter, etc., the surface size composition on the paper substrate surface. The rod may be stationary or movable relative to the paper substrate.

For the purposes of the present invention, the term "gated roll metering size press" refers to a metering size press that may use a gated roll, transfer roll, soft applicator roll, etc. The gated roll, transfer roll, soft applicator roll, etc., may be stationery relative to the paper substrate, may rotate relative to the paper substrate, etc.

For the purposes of the present invention, the term "doctor blade metering size press" refers to a metering press which may use a doctor blade to spread, meter, etc., the surface size composition on the paper substrate surface.

For the purposes of the present invention, the term "room temperature" refers to the commonly accepted meaning of room temperature, i.e., an ambient temperature of 20° to 25° C.

For the purposes of the present invention, the term "surface coverage" refers to amount of a composition present on a given side or surface of the paper substrate being treated. Surface coverage may be defined in terms of grams of composition per square meter of paper substrate (hereinafter referred to as "gsm").

For the purpose of the present invention, the term "treating" with reference to the surface size compositions, etc., may include depositing, applying, spraying, coating, daubing, spreading, wiping, dabbing, dipping, etc.

For the purpose of the present invention, the term "Hercules Sizing Test" or "HST" refers to a test of resistance to penetration of, for example, an acidic water solution through a paper substrate. The HST may be measured using the procedure of TAPPI Standard Method 530 pm-89. See U.S. Pat. No. 6,764,726 (Yang et al.), issued Jul. 20, 2004, the entire disclosure and contents of which is hereby incorporated by reference. The HST value is measured following the conventions described in TAPPI Standard Method number T-530 pm-89, using 1% formic acid ink and 80% reflectance endpoint. The HST value measured reflects the relative level of sizing agent present in and/or on the paper substrate. For example, lower HST values reflect a relatively low level of paper sizing present in the paper substrate. Conversely, higher HST values reflect a relatively high level of paper sizing present in and/or on the paper substrate. For printable substrates useful in embodiments of the present invention, the HST value may about 350 seconds or less, such as about 100 second or less, and, for example, in the range from about 5 to about 350 seconds, such as from about 10 to about 100 seconds. The HST value measured also reflects both the level of both internal sizing, as well as the level of surface sizing present. But at the relatively low levels of sizing agents normally used in papermaking (e.g., from about 1 to about 2 lbs/ton or from about 0.04 to about 0.08 gsm for paper substrates having a basis weight of 20 lbs/1300 $ft.^2$), the HST value of the paper substrate primarily (if not exclusively) reflects the contribution imparted by the internal sizing agents (which generally increase HST values greatly even at low usage levels), rather than surface sizing agents (which generally increase HST values minimally at such low usage levels).

For the purposes of the present invention, the term "internal sizing" refers to sizing present in the paper substrate due to internal paper sizing agents which are included, added, etc., during the papermaking process before a fibrous paper substrate is formed. Internal paper sizing agents generally resist penetration of water or other liquids into the paper substrate by reacting with the paper substrate to make the paper substrate more hydrophobic. Illustrative internal paper sizing agents may include, for example, alkyl ketene dimers, alkenyl succinic anhydrides, etc.

For the purposes of the present invention, the term "surface sizing" refers to sizing agents which are applied on, added to, etc., the surface(s) of the paper substrate. Surface sizing agents generally resist penetration of water or other liquids into the paper substrate by covering the paper substrate with a more hydrophobic film. Illustrative surface sizing agents may include, for example, starch, modified starch, styrene maleic anhydride copolymers, styrene acrylates, polyvinyl alcohol (PVOH), etc.

For the purposes of the present invention, the term "surface sizing starch" refers to surface sizing agents for paper substrates which comprise one or more natural starches (i.e., unmodified starches obtained from plant sources such as maize, wheat, rice, potato, tapioca, etc.) such as cereal starches (e.g., corn starch, wheat starch, rice starch, potato starch, oat starch, rye starch, barley starch, millet sorghum starch, etc.) and non-cereal starches (e.g., tapioca starch, etc.), modified natural starches (e.g., ethylated starches, oxidized starches, such as oxidized corn starch, etc.), or combinations thereof. Modified starches (e.g., oxidized starches such as oxidized corn starch) may be obtained by one or more chemical treatments known in the paper sizing starch art, for example, by oxidation to convert some of —$CH_2OH$ groups to —COOH groups, etc. In some cases the modified starch may have a small proportion of acetyl groups. Alternatively, the starch may be chemically modified to render it cationic (i.e., a cationic starch) or amphoteric (i.e., an amphoteric starch), i.e., with both cationic and anionic charges. The modified starches may also include starches converted to a starch ether, or a hydroxyalkylated starch by replacing some —OH groups with, for example, —$OCH_2CH_2OH$ groups (i.e., a hydroxyethylated starch), —$OCH2CH_3$ groups (i.e., an ethylated starch), —$OCH_2CH_2CH_2OH$ groups (i.e., a propylated starch), etc.

For the purposes of the present invention, the term "optical brightener agent (OBA)" refers to certain fluorescent materials which may increase the brightness (e.g., white appearance) of paper substrate surfaces by absorbing the invisible portion of the light spectrum (e.g., from about 340 to about 370 nm) and converting this energy into the longer-wavelength visible portion of the light spectrum (e.g., from about 420 to about 470 nm). In other words, the OBA converts invisible ultraviolet light and re-emits that converted light into blue to blue-violet light region through fluorescence. OBAs may also be referred to interchangeably as fluorescent whitening agents (FWAs) or fluorescent brightening agents (FBAs). The use of OBAs is often for the purpose of compensating for a yellow tint or cast of paper pulps which have, for example, been bleached to moderate levels. This yellow tint or cast is produced by the absorption of short-wavelength light (violet-to-blue) by the paper substrate. With the use of OBAs, this short-wavelength light that causes the yellow tint or cast is partially replaced, thus improving the brightness and whiteness of the paper substrate. OBAs are desirably optically colorless when present on the paper substrate surface, and do not absorb light in the visible part of the spectrum. These OBAs are anionic and may include one or more of: 4,4'-bis-(triazinylamino)-stilbene-2,2'-disulfonic acids, 4,4'-bis-(triazol-2-yl)stilbene-2,2'-disulfonic acids, 4,4'-dibenzofuranyl-biphenyls, 4,4'-(diphenyl)-stilbenes, 4,4'-distyryl-biphenyls, 4-phenyl-4'-benzoxazolyl-stilbenes, stilbenzyl-naphthotriazoles, 4-styryl-stilbenes, bis-(benzoxazol-2-yl) derivatives, bis-(benzimidazol-2-yl) derivatives, coumarins, pyrazolines, naphthalimides, triazinyl-pyrenes, 2-styryl-benzoxazole or -naphthoxazoles, benzimidazole-benzofurans or oxanilides, etc, See commonly assigned U.S. Pat. No. 7,381,300 (Skaggs et al.), issued Jun. 3, 2008, the entire contents and disclosure of which is herein incorporated by reference. In particular, these OBAs may comprise, for example, one or more stilbene-based sulfonates (e.g., disulfonates, tetrasulfonates, or hexasulfonates) which may comprise one or two stilbene residues. Illustrative examples of such anionic stilbene-based sulfonates may include 1,3,5-triazinyl derivatives of 4,4'-diaminostilbene-2,2'-disulphonic acid (including salts thereof), and in particular the bistriazinyl derivatives (e.g., 4,4-bis(triazine-2-ylamino)stilbene-2,2'-disulphonic acid), the disodium salt of distyrlbiphenyl disulfonic acid, the disodium salt of 4,4'-di-triazinylamino-2,2'-di-sulfostilbene, etc. Commercially available disulfonate, tetrasulfonate and hexasulfonate stilbene-based OBAs may also be obtained, for example, from Ciba Geigy under the trademark TINOPAL®, from Clariant under the trademark LEUCOPHOR®, from Lanxess under the trademark BLANKOPHOR®, and from 3V under the trademark OPTIBLANC®.

For the purposes of the present invention, the term "comprising" means various compounds, components, polymers, ingredients, substances, materials, layers, steps, etc., may be conjointly employed in embodiments of the present invention. Accordingly, the term "comprising" encompasses the more restrictive terms "consisting essentially of" and "consisting of."

For the purposes of the present invention, the term "and/or" means that one or more of the various compositions, compounds, polymers, ingredients, components, elements, capabilities, steps, etc., may be employed in embodiments of the present invention.

Description

In trying to secure lower cost printable paper substrates for inkjet printing, users have tried lower basis weight, lower cost printable paper substrates to create, for example, printed documents. But when using such prior lower basis weight, lower cost printable paper substrates with inkjet printers, the user may run the risk of having increased showthrough with such printable substrates when printed on both sides, thus making it more difficult to read either side due to the print from the other side showing through the printed substrate. The use of printable substrates having a higher basis weight, increased opacity due to the inclusion of higher amounts of substrate fillers, etc., may reduce undesired showthrough but may also increase the cost of the printable substrate to be used with inkjet printers. In addition, besides increasing the cost of the printable substrate, higher levels of substrate fillers (e.g., paper pigments) to increase opacity may also lower the tensile strength of the printable substrate in both the machine direction (MD), as well as well as in the cross-machine direction (CD), thus making such lower basis weight substrates more fragile and flimsy, as well as lowering inkjet printing productivity.

Embodiments of the present create lower cost printable substrates having a low basis weight, lower showthrough, as well as good productivity, to enable inkjet printers to prepare, at lower cost, various inkjet printed documents. The low basis weight paper substrates used in embodiments of the present invention have a basis weight in the range of from about 12 to about 32 lbs/1300 $ft^2$, such as from about 15 to about 25 lbs/1300 $ft^2$ (e.g., from about 18 to about 20 lbs/1300 $ft^2$). These paper substrates comprise paper fibers in an amount in the range of from about 60 to 100% by weight of the paper substrate, such from about 70 to about 90% by weight of the paper substrate (e.g., from about 75 to about 85% by weight of the paper substrate). These paper fibers may be one or more of softwood fibers, hardwood fibers, and/or synthetic fibers, including paper fibers comprising all softwood fibers, all hardwood fibers, or various mixtures of softwood and hardwood fibers. For example, the paper fibers may comprise from about 10 to about 40% by weight softwood fibers and from about 60 to about 90% by weight hardwood fibers, such as from about 25 to about 35% by weight softwood fibers and from about 65 to about 75% by weight hardwood fibers. Synthetic fibers may also be included, for example, in amounts of from about 5 to about 20% by weight of the total paper fibers.

These paper substrates may further comprise substrate filler (e.g., calcium carbonate) in an amount in the range of from 0 to about 30% by weight of the paper substrate, such from about 10 to about 25% by weight of the paper substrate (e.g., from about 15 to about 20% by weight of the paper substrate). Inclusion of the substrate filler may aid in increasing the opacity of the printable substrate to a value of at least about 88%, such as at least about 90% (e.g., at least about 92%), as well as minimizing showthrough to a value of about 0.14 or less, such as about 0.13 or less (e.g., about 0.12 or less). These paper substrates may also optionally comprise a cationic starch binder (e.g., to improve substrate filler retention, dry strength, etc.) in an amount in the range of from about 0.05 to about 3% by weight of the paper substrate, such from about 0.08 to about 2.5% by weight of the paper substrate (e.g., from about 0.1 to about 2% by weight of the paper substrate).

One or both surfaces of this paper substrate is a surface size layer comprising at least a multivalent metal salt drying agent (e.g., calcium chloride), and optionally a starch sizing agent. The amount of multivalent metal salt drying agent present in this surface size layer(s) is sufficient to impart a black print density value of at least about 0.8, for example, at least about 1.0, such as at least about 1.2, (for example, in the range of from about 0.8 to about 1.5, such as from about 1.0 to about 1.3) when inkjet printed with pigmented inks, as well as waterfastness value of at least about 85%, such as at least about 90%, when inkjet printed with dye-based inks. The optional starch sizing agent is present in the surface size layer(s) an amount of about 50 lbs or less per ton of the paper substrate, such as about 10 lbs or less per ton of the paper substrate, such as in the range of from about 0.1 to about 10 lbs per ton of the paper substrate, but may also be omitted entirely from the surface size layer(s), as decreasing the level of starch sizing agent in the surface size layer(s) has been found to reduce the degree of showthrough caused when the printable substrate is printed on both sides of the printable substrate.

Embodiments of the printable substrates of the present invention provide one or more of the following benefits: (a) lower showthrough; (b) use of a lower basis weight paper substrate to thus lower cost; (c) good print density for both dye-based and pigmented inks used with the inkjet printers; (d) some waterfastness for most inks, especially dye-based; (e) great dimensional stability, low cockle and curl; (f) the printed paper sheets which may be perforated, punched, converted, etc., with no or minimal issues; and (g) maintains sufficient tensile strength, bonding, and stiffness. Tensile strength values for embodiments of the printable substrates are at least about 12 lbs/inc., such as at least about 20 lbs/in. (e.g., in the range of from about 25 to about 35 lbs./in.) in the machine direction (MD), and at least about 6 lbs/inc., such as at least about 7 lbs/in. (e.g., in the range of from about 8 to about 12 lbs./in.) in the cross-machine direction (CD).

Embodiments of the present invention also relate to a method for preparing such printable substrates. In this method, a surface size layer (e.g., as a surface size composition comprising the multivalent metal salt drying agent, optionally the starch sizing agent, as well as other optional ingredients such as optical brightening agents (OBAs) to improve whiteness and color, monovalent salts such as sodium chloride to control static, etc. is formed one or both surfaces of the paper substrate (as defined above) by using, for example, a size press to apply the surface size composition to those surfaces.

An embodiment of a method of the present invention for treating one or both surfaces of the paper substrate with such a surface size composition comprising the metal salt drying agent (optionally starch surface sizing agent, plus other optional ingredients such as OBAs, sodium chloride, etc.) is further illustrated in FIG. 1. Referring to FIG. 1, an embodiment of a system for carrying out an embodiment of the method of the present invention is illustrated which may be in the form of, for example a rod metering size press indicated generally as 100. Size press 100 may be used to surface size a paper substrate, indicated generally as 104. Substrate 104 moves in the direction indicated by arrow 106, and which has a pair of opposed sides or surfaces, indicated, respectively, as 108 and 112.

Size press 100 includes a first assembly, indicated generally as 114, for applying the surface size composition to surface 108. Assembly 114 includes a first reservoir, indicated generally as 116, provided with a supply of a surface size composition, indicated generally as 120. A first take up roll, indicated generally as 124 which may rotate in a counterclockwise direction, as indicated by curved arrow 128, picks up an amount of the surface size composition from supply 120. This amount of surface size composition that is picked up by rotating roll 124 may then be transferred to a first applicator roll, indicated generally as 132, which rotates in the opposite and clockwise direction, as indicated by curved arrow 136. (The positioning of first take up roll 124 shown in FIG. 1 is simply illustrative and roll 124 may be positioned in various ways relative to first applicator roll 132 such that the surface size composition is transferred to the surface of applicator roll 132.) The amount of surface size composition that is transferred to first applicator roll 132 may be controlled by metering rod 144 which spreads the transferred composition on the surface of applicator roll 132, thus providing relatively uniform and consistent thickness of a first surface size layer, indicated as 148, when applied onto the first surface 108 of substrate 104 by applicator roll 132.

As shown in FIG. 1, size press 100 may also be provided with a second assembly indicated generally as 152, for applying the surface size composition to surface 112. Assembly 152 includes a second reservoir, a second supply of the surface size composition, and a second take up roll (similar to reservoir 116, supply 120, and take up roll 124) which is indicated generally by the dashed-line box and arrow 156. As shown in FIG. 1, the amount of surface size composition that is transferred from second supply reservoir/second take-up roll 156 to second applicator roll 160 (which rotates in a clockwise direction, as indicated by curved arrow 164) may be controlled by a second metering rod 168 which spreads the transferred second supply of surface size composition on the surface of applicator roll 160, thus providing a relatively uniform and consistent thickness of the second surface size layer, indicated as 172, when applied onto the second surface 112 of substrate 104 by applicator roll 160.

Figure 2:
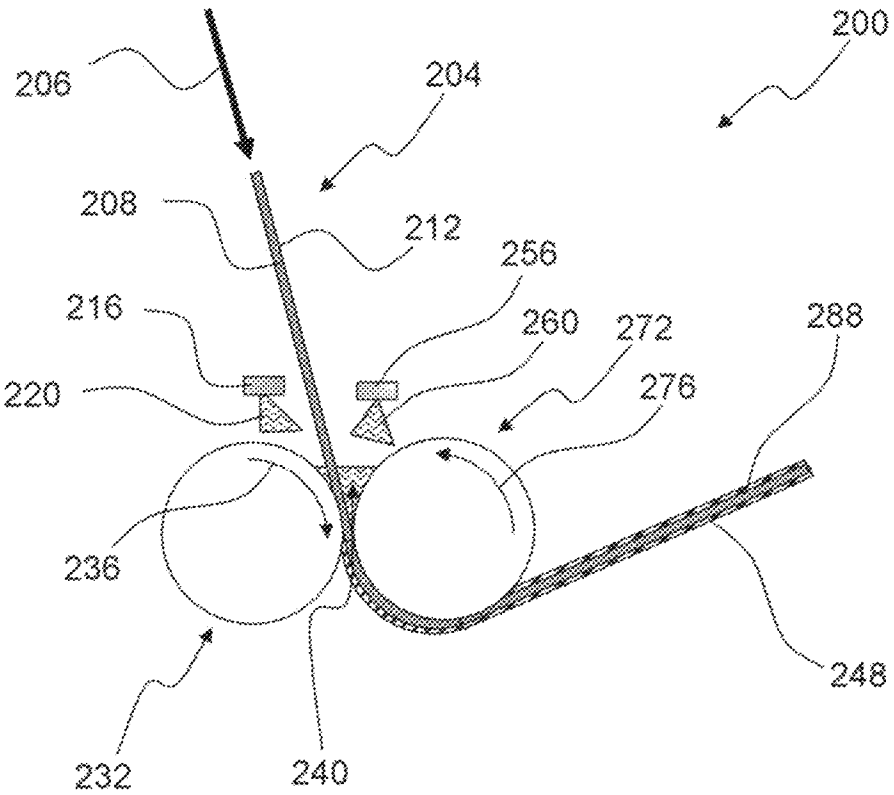
FIG. 2 is a schematic diagram illustrating an embodiment of a method for treating one or both surfaces of a paper substrate with a coating composition using a horizontal flooded nip size press.

Referring to FIG. 2, another embodiment of a system for carrying out an embodiment of the method of the present invention is illustrated which may be in the form of, for example, a horizontal flooded nip size press indicated generally as 200. Horizontal size press 300 may be used to provide a paper web, indicated generally as 204, with a surface size composition (e.g., as described in FIG. 1 above). Web 204 moves in the direction indicated by arrow 206, and has a pair of opposed sides or surfaces, indicated, respectively, as 208 and 212.

Horizontal size press 200 includes a first source of surface size composition, indicated generally as nozzle 216, which is sprays a stream of the surface size composition, indicated by 220, generally downwardly towards the surface of a first transfer roll, indicated as 232, which rotates in a clockwise direction, as indicated by curved arrow 236. A flooded pond or puddle, indicated generally as 240, is created at the nip between first transfer roll 232 and second transfer roll 272 due to a bar or dam (not shown) positioned at below the nip. Transfer roll 232 transfers a relatively uniform and consistent first layer of the surface size composition, indicated as 248, onto the first surface 208 of web 204.

A second source of surface size composition, indicated generally as nozzle 256, which is sprays a stream of the surface size composition, indicated by 260, generally downwardly towards the surface of a second transfer roll, indicated as 272, which rotates in a counterclockwise direction, as indicated by curved arrow 276. Transfer roll 272 transfers a relatively uniform and consistent second layer of the surface size composition, indicated as 288, onto the second surface 212 of web 204.

Figure 3:
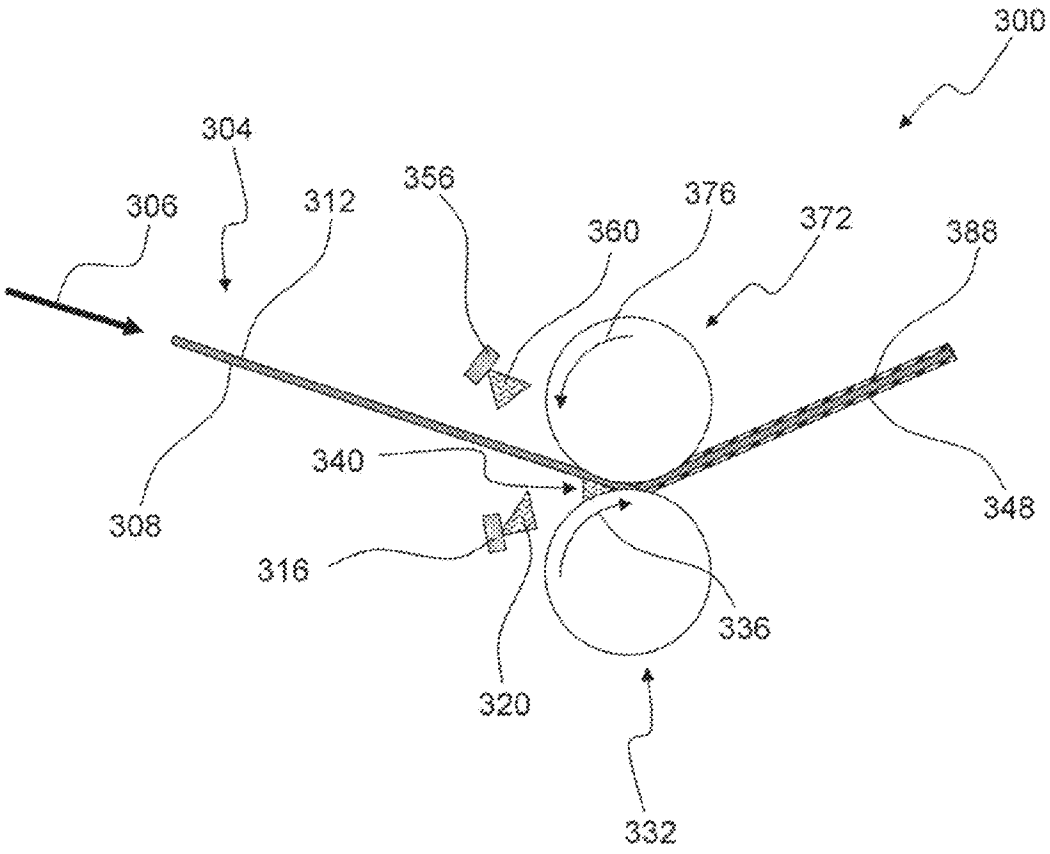
FIG. 3 is a schematic diagram illustrating an embodiment of a method for treating one or both surfaces of a paper substrate with a coating composition using a vertical flooded nip size press.

Referring to FIG. 3, another embodiment of a system for carrying out an embodiment of the method of the present invention is illustrated which may be in the form of, for example, a vertical flooded nip size press indicated generally as 300. Vertical size press 300 may be used to provide a paper web, indicated generally as 304, with a surface size composition (e.g., as described in FIG. 1 above). Web 304 moves in the direction indicated by arrow 306, and has a pair of opposed sides or surfaces, indicated, respectively, as 308 and 312.

Vertical size press 300 includes a first source of surface size composition, indicated generally as nozzle 316, which is sprays a stream of the surface size composition, indicated by 320, generally upwardly and towards the surface of a first lower transfer roll of the roll stack, indicated as 332, which rotates in a clockwise direction, as indicated by curved arrow 336. A smaller flooded pond or puddle, indicated generally as 340, (compared to the pond or puddle 340 of horizontal size press 300) is created at the nip between lower first transfer roll 332 and second upper transfer roll 372 due to a bar or dam (not shown) positioned to right of the nip. Transfer roll 332 transfers a relatively uniform and consistent first layer of the surface size composition, indicated as 348, onto the lower first surface 308 of web 304.

A second source of surface size composition, indicated generally as nozzle 356, sprays a stream of the surface size composition, indicated by 360, generally downwardly and towards the surface of a second upper transfer roll, indicated as 372, which rotates in a counterclockwise direction, as indicated by curved arrow 376. Transfer roll 372 transfers a relatively uniform and consistent second layer of the surface size composition, indicated as 388, onto the upper second surface 312 of web 304.

Showthrough Test Methodology

Detection Equipment used: Densitometer (X-rite 528, using settings of Visual Color, status T, absolute density mode, and aperture of 6 mm).

Inkjet Printers used: (1) Pigmented Ink Printer, such as HP Officejet Pro 8100 using HP #950 ink cartridge, using plain paper mode with normal print quality setting); (2) Dye Ink Printer such as Epson C88+ using Epson High Speed Dye-Based Inkjet Inks, using plain paper mode, and normal print quality setting; or (3) any other inkjet printer, such as Canon ColorStream 3000, using any dye-based or pigmented inks, at any loading suitable for printing.

Procedure used: Printing (with any of the inkjet printers (1), (2), or (3) described above) a black box that is about 1 inch by 1 inch in size on the front side of the printable substrate sheet. Using the Densitometer described above, measure the density of the printed area on the back side (i.e., the side opposite the printed front side of the printed substrate sheet) of the printed substrate sheet. Measure with the Densitometer 3 times per printed area per printed substrate sheet, the average of the 3 measurements obtained being the showthrough value. The showthrough value is deemed a "standardized showthrough" value if printed with either inkjet printer (1) or (2) above. This standardized showthrough value is sufficient for quantifying the showthrough quality of a printable substrate sample relative to a known scale of showthrough values. The showthrough value is deemed to be a "generic showthrough" value if printed using printer (3) above. Generic showthrough values may be useful for comparing substrates printed on a specific printer at same settings, but these generic showthrough values may not allow for rating against a known scale of showthrough values, (as in the "standardized showthrough" values.) Unless otherwise stated herein, the showthrough values referred to herein (including for the appended claims) are "standardized showthrough" values.

EXAMPLES

Samples of printable paper substrates are prepared as follows: The paper substrate used is made from bleached cellulose fibers comprising about 79% by weight of the paper substrate. These paper fibers comprise about 75% by weight hardwood bleached fibers and about 25% by weight bleached softwood fibers. The paper substrate also comprises about 20% by weight substrate filler in the form of precipitated calcium carbonate, about 1% by weight internal cationic starch, about 0.75% by weight OBA, and about 0.25% by weight sodium chloride. This paper substrate has a basis weight of approximately 20 lbs/1300 $ft^2$.

A lab scale puddle size press is used to apply various surface size compositions to both surfaces of the paper substrate. These surface size compositions comprise one or more of: a starch sizing agent in the form of an ethylated starch (Tate & Lyle Ethylex 2040); calcium chloride; and/or hydrophobic surface sizing agent (Chromaset 700).

These samples with applied surface size layers are evaluated for print density (OD), showthrough (ST), and opacity (OP) when inkjet printed with both dye-based (DI) and pigmented (PI) inks. The results of these evaluations are shown in Table 1 below:

TABLE 1

| Sample (S) | Starch[1] (lbs/ton) | $CaCl_2$[2] (lbs/ton) | Chromaset[3] (lbs/ton) | DI (OD) | DI (ST) | PI (OD) | PI (ST) | OP (%) |
|---|---|---|---|---|---|---|---|---|
| 1 | 0 | 0 | 0 | 1.2 | 0.12 | 1.1 | 0.12 | 93.2 |
| 2 | 125 | 0 | 0 | 1.24 | 0.15 | 1.1 | 0.12 | 92.2 |
| 3 | 125 | 0 | 2 | 1.23 | 0.15 | 1.1 | 0.12 | 92.2 |
| 4 | 80 | 0 | 0 | 1.22 | 0.13 | 1.04 | 0.12 | 92.5 |
| 5 | 80 | 8 | 0 | 1.2 | 0.14 | 1.14 | 0.13 | 92.5 |
| 6 | 80 | 8 | 2 | 1.2 | 0.135 | 1.21 | 0.12 | 92.8 |
| 7 | 40 | 0 | 0 | 1.2 | 0.13 | 1.01 | 0.12 | 93.6 |
| 8 | 40 | 8 | 0 | 1.2 | 0.14 | 1.1 | 0.12 | 93.1 |
| 9 | 40 | 8 | 2 | 1.2 | 0.135 | 1.14 | 0.125 | 93.2 |
| 10 | 0 | 8 | 0 | 1.2 | 0.12 | 1.2 | 0.12 | 93.2 |
| 11 | 0 | 8 | 2 | 1.2 | 0.12 | 1.21 | 0.1125 | 93.6 |

Figure 4:
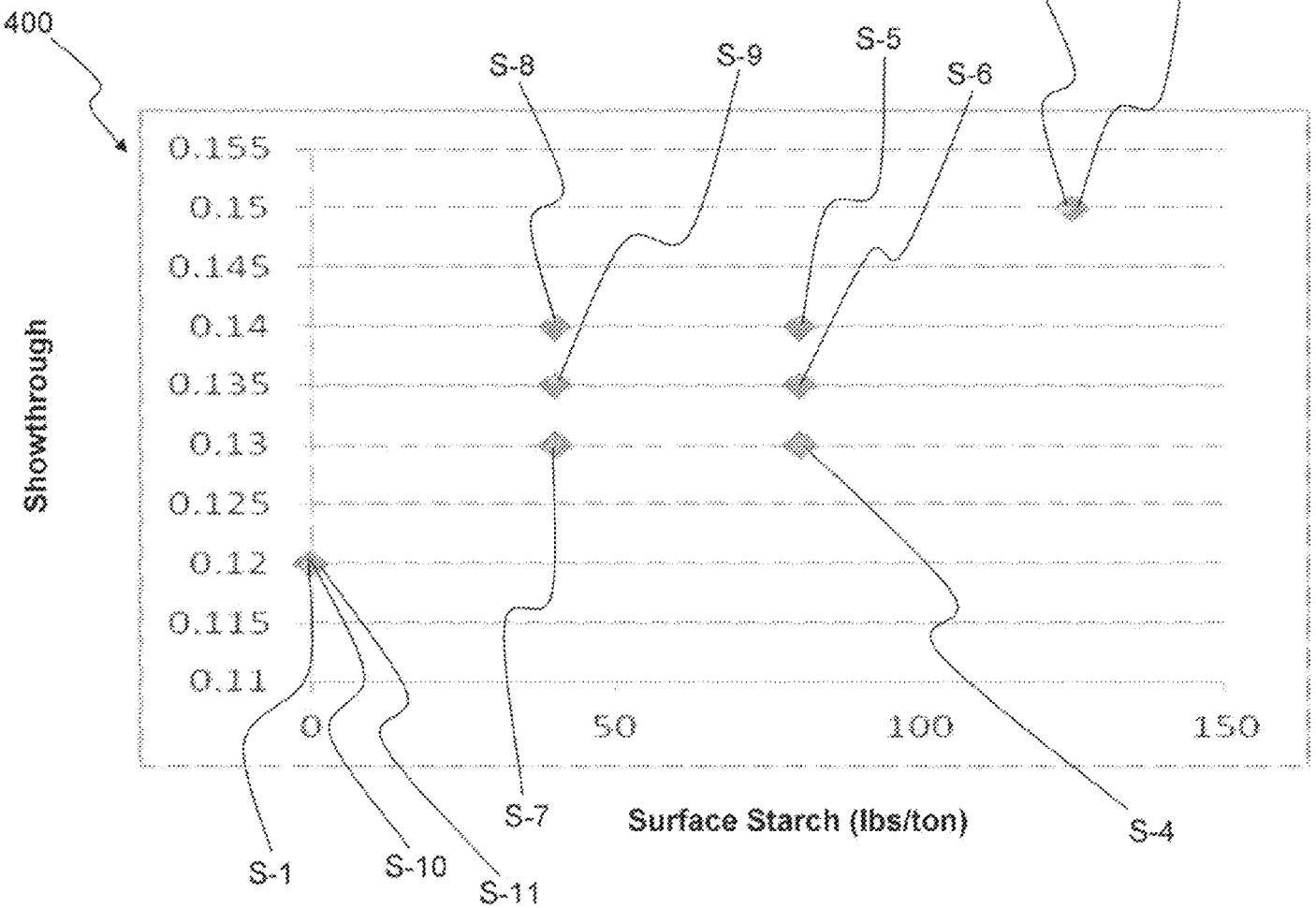
FIG. 4 shows a graphical plot of showthrough versus starch size amount (lbs./ton) for 11 samples (S-1 through S-11) of printable substrates prepared from a low basis weight paper substrate having applied to both surfaces with a puddle size press surface size compositions comprising differing amounts of one or more of: a starch sizing agent (ethylated starch); calcium chloride; and/or a hydrophobic surface sizing agent (Chromaset 700)
Figure 5:
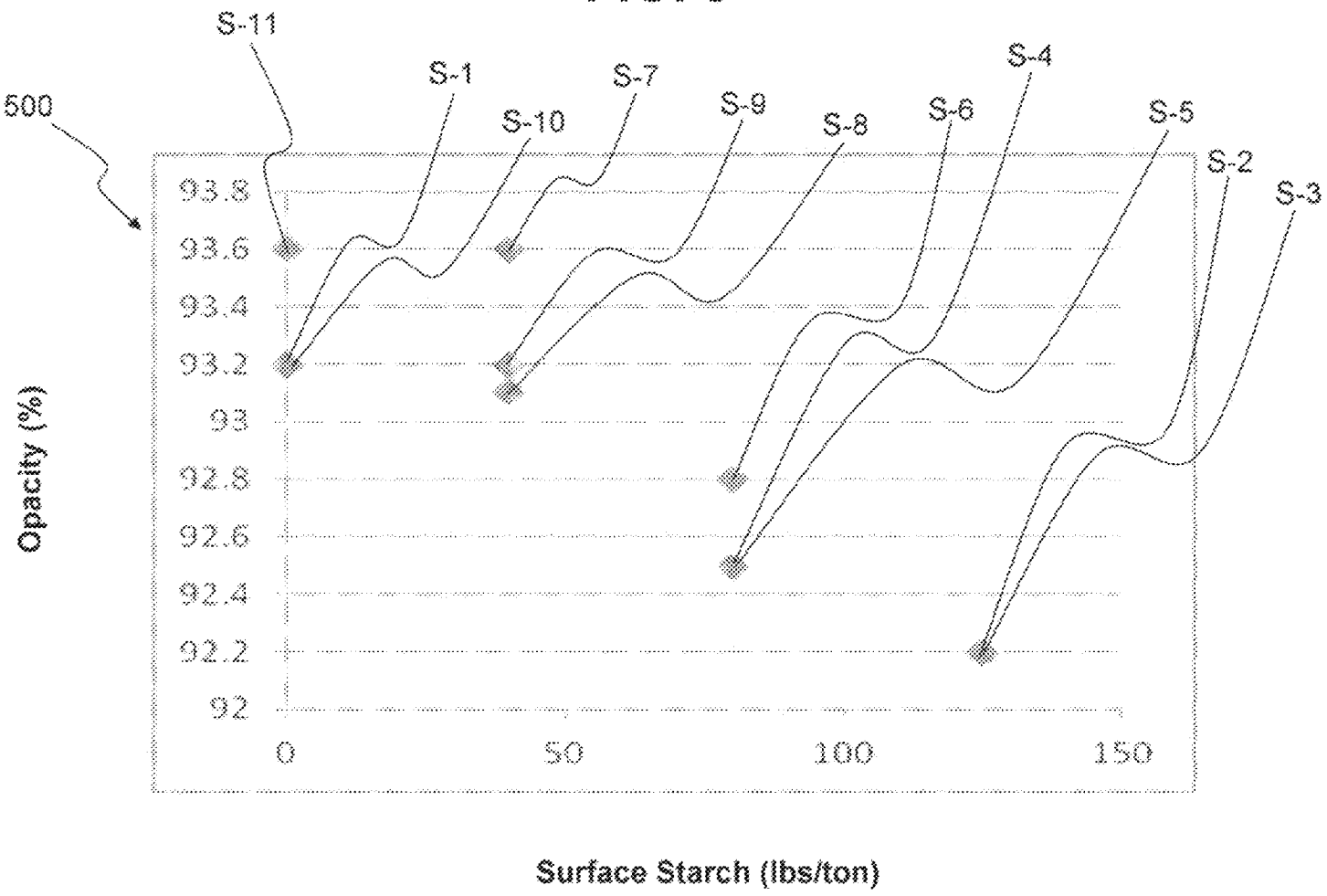
FIG. 5 shows a graphical plot of opacity versus starch surface sizing agent amount (lbs./ton) for the same 11 samples (S-1 through S-11) of printable substrates.
Figure 6:
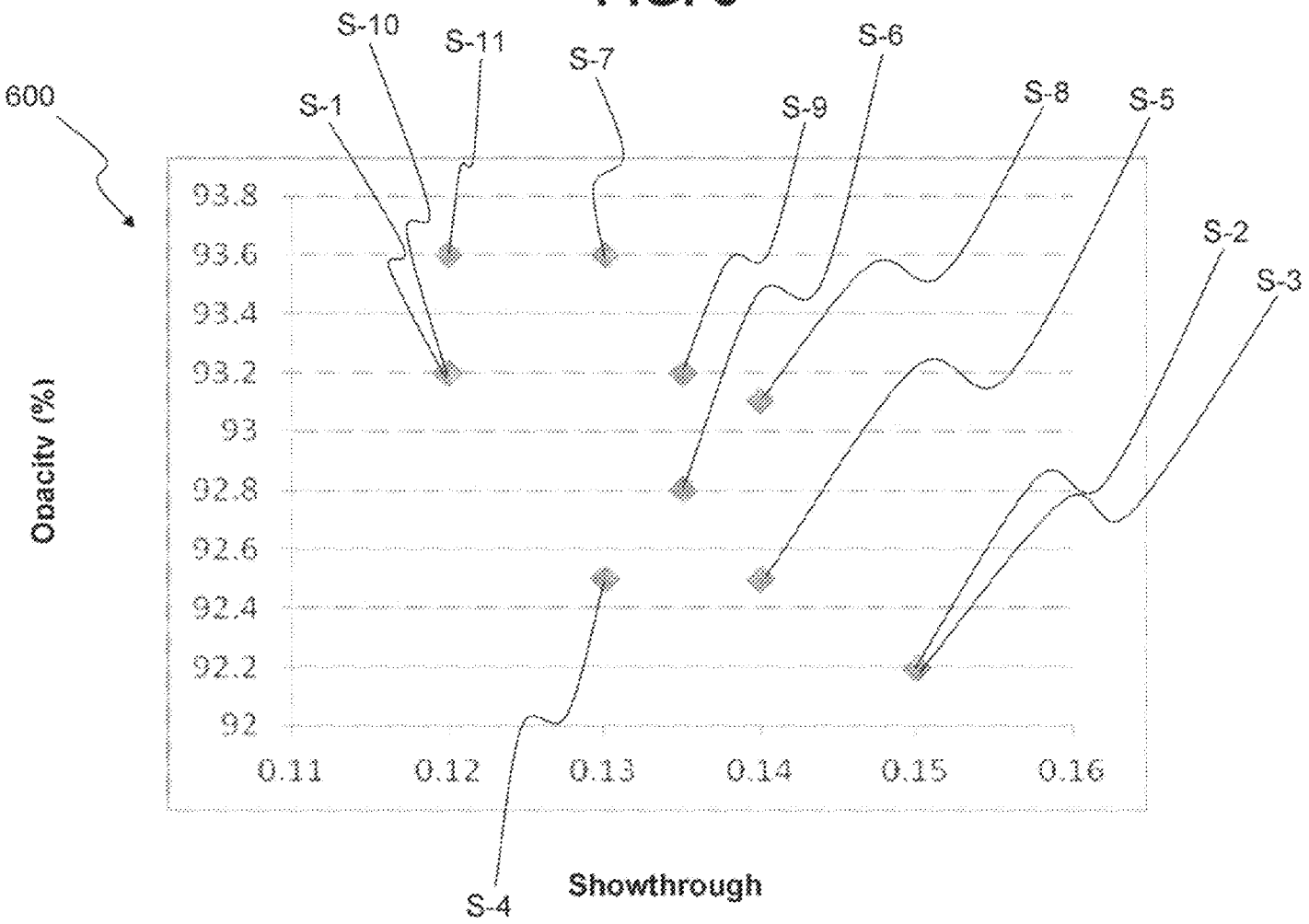
FIG. 6 shows a graphical plot of opacity versus showthrough for the same 11 samples (S-1 through S-11) of printable substrates.

[1]Ethylated starch (Tate & Lyle Ethylex 2040)
[2]DOWFLAKE ™ XTRA 83-87% CALCIUM CHLORIDE FLAKES, from Occidental Chemical Corporation, dissolved in water
[3]Chromaset 700, a hydrophobic size agent The data for each of these 11 samples in Table 1 above (referred to as S-1 through S-11) is graphically plotted in FIG. 4 (showthrough versus starch size amount, in FIG. 5 (opacity versus starch surface sizing agent amount), and FIG. 6 (opacity versus showthrough). As shown by the graphical plots in FIGS. 4 through 6: (a) showthrough decreases (improves) as the amount of starch surface sizing agent is lowered (see FIG. 4); (b) opacity increases as the amount of starch surface sizing agent is lowered (see FIG. 5); (c) showthrough is a function of opacity in that as opacity increases, less of the printed ink is visible on the side opposite the printed side (see FIG. 6); and (d) as opacity increases, showthrough decreases, (see FIG. 6).

Separately, the showthrough properties of an embodiment of the printable substrate of the present invention (Invention) is compared to those of a control printable substrate (Control). The composition and properties of the Invention and Control printable substrates are shown in Table 2 below:

TABLE 2

| | Contro[1] | Invention[1] |
|---|---|---|
| Hardwood/Softwood Fiber Composition (%) | 70/30 | 70/30 |
| Substrate Filler (%)[2] | 22 | 18 |
| HST (sec.) | 90 | 310 |
| Cationic Starch Binder (lbs/ton)[3] | 10 | 10 |
| Starch Surface Size (lbs/ton)[3] | 120 | 0 |
| Calcium Chloride (lbs/ton)[3] | 25 | 25 |
| Opacity (%) | 89.9 | 91.1 |
| Sheffield Smoothness (Topside/Backside) | 142/162 | 143/165 |
| Gurley Porosity (seconds) | 28 | 13 |
| Wax Pick Test | 16 | 12 |

Figure 7:
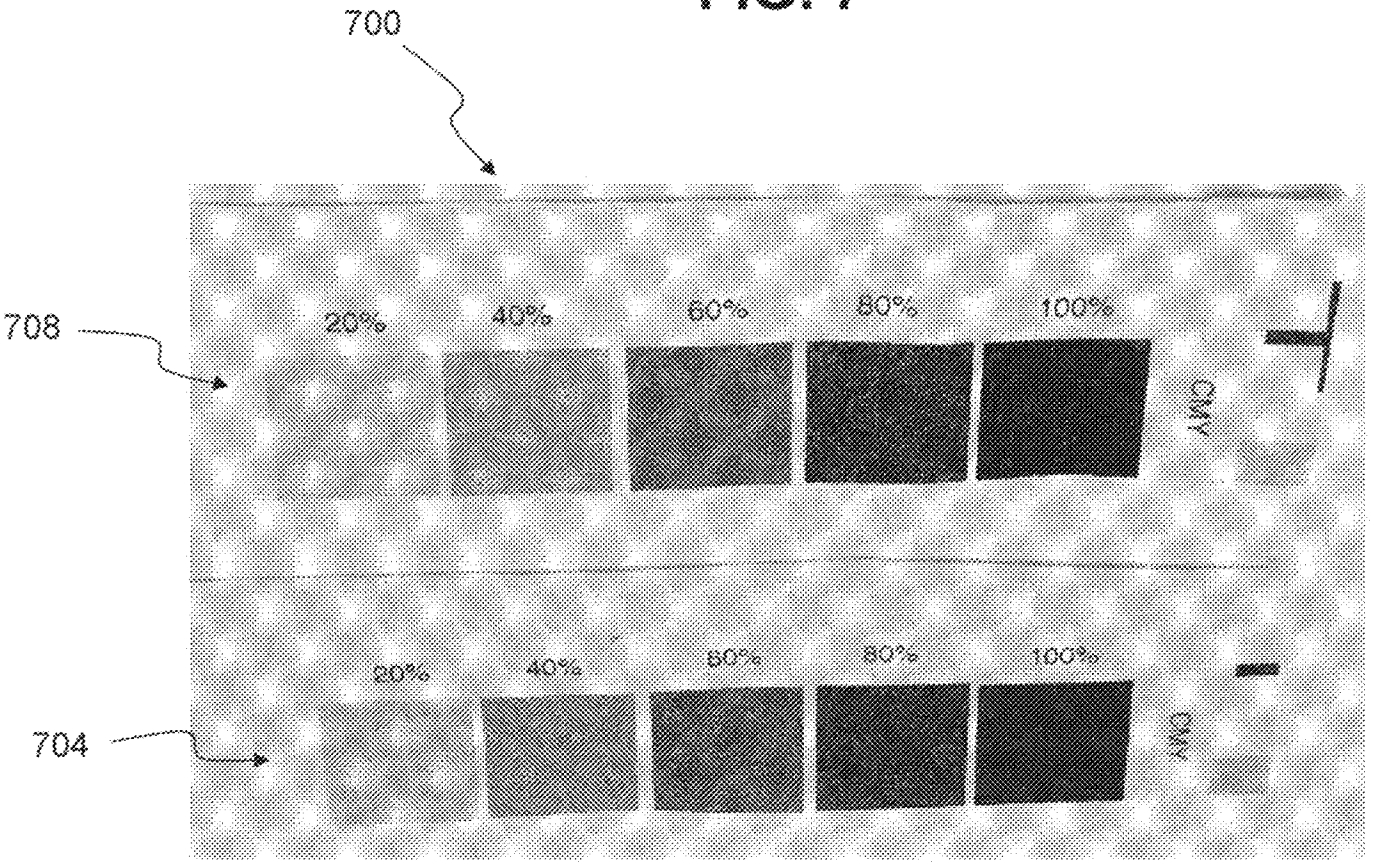
FIG. 7 is a scanned image comparing the respective front, inkjet printed sides of a control printable substrate and an embodiment of a printable substrate according to the present invention.

[1]Basis weight of paper substrate: 20 lbs/1300 $f^2$
[2]Calcium carbonate
[3]Sta-Lok 330
[4]Ethylated starch The calcium chloride and ethylated starch are applied by using a metering size press FIG. 7 is scanned image, indicated generally as 700, of the Control and Invention printable substrates printed on one side using an inkjet printer. The sample of the Control and the sample of Invention are inkjet printed on the one side using Canon ColorStream 3000, high speed inkjet printer. Print speed is about 200 feet per minute with a maximum ink loading of 80%. The test pattern printed on printed substrate samples of the Control and the Invention (i.e., a series of adjacent squares) is a composite black, where three color inks (cyan, magenta and yellow) are printed in the same test pattern, and thus combine to create the composite black. The printed substrate sample for the Control is indicated as 704, while the printed substrate sample for the Invention is indicated as 708. The percentages shown FIG. 7 for Control sample 704 and Invention sample 708 represent the target coverage for each of the respective squares. For example, "20%" for the rightmost squares means that 20% of the area of that square is covered with black printed dots while the remaining 80% of the area of that square is unprinted (i.e., has no black printed dots).

Figure 8:
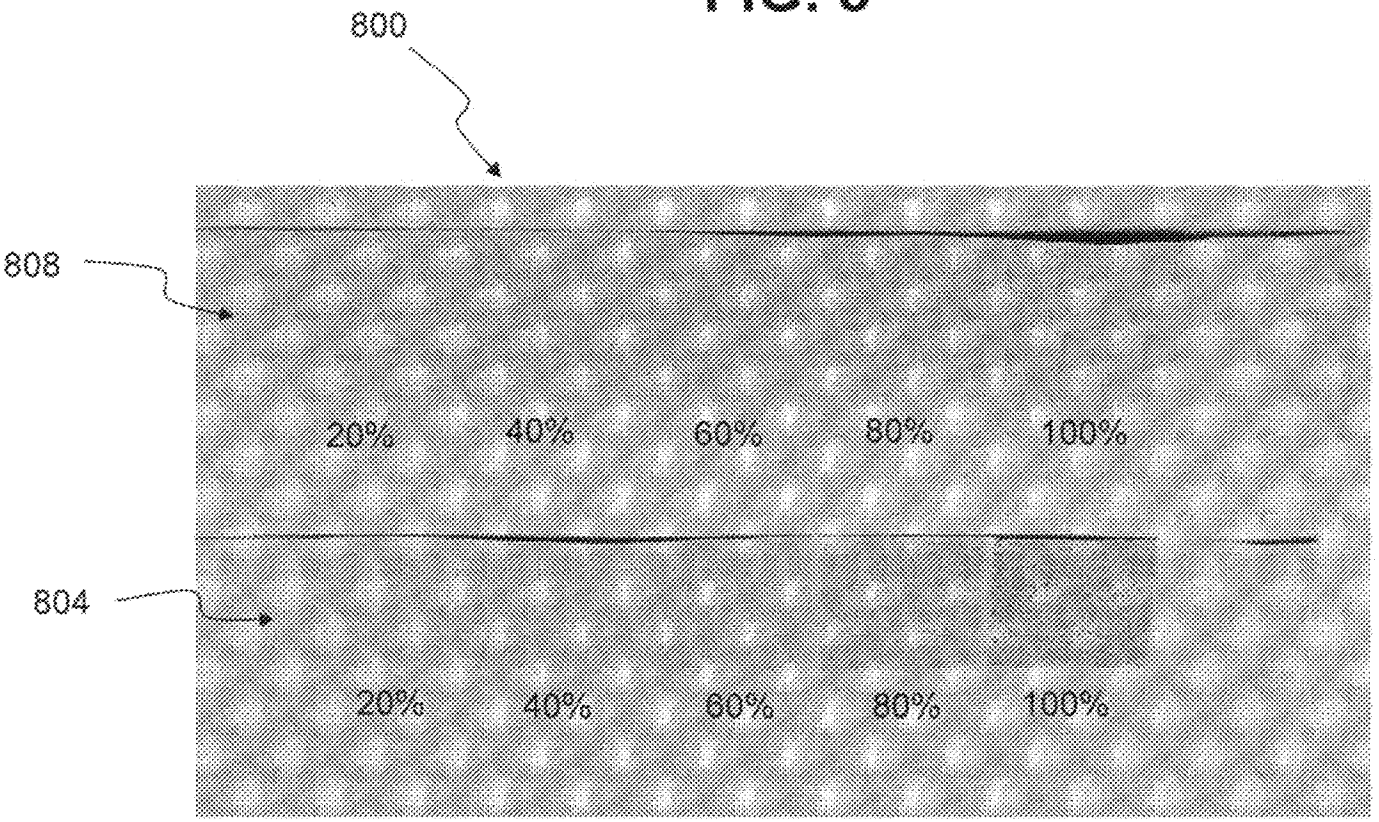
FIG. 8 is a scanned image comparing the respective back sides of the control printable substrate and an embodiment of a printable substrate according to the present invention of FIG. 7 to illustrate the degree of showthrough from the respective front, printed sides.

FIG. 8 is scanned image, indicated generally as 800, of the back (unprinted) side of the Control sample, indicated as 804, and the Invention, indicated as 808. In FIG. 8, the showthrough of the back side 804 of the Control sample is compared to that of the back side 808 of the Invention sample. As can be seen in FIG. 8, the printed substrate of the Invention has visually less showthrough (measured to be 0.11) compared to that of the printed substrate of the Control (measured to be 0.18), which is most visible when comparing the respective 100% squares. These measured showthrough values for the Control and Invention samples are "generic showthrough" values.

All documents, patents, journal articles and other materials cited in the present application are hereby incorporated by reference.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless they depart therefrom.

What is claimed is:

1. An article comprising a printable substrate, the printable substrate comprising:

a paper substrate having a first surface and a second surface, a basis weight of from about 12 to about 32 lbs/1300 $ft^2$, a showthrough value of about 0.14 or less, and an opacity value of at least about 88%, the paper substrate comprising:

paper fibers in an amount of from 60 to 100% by weight of the paper substrate; and a substrate filler in an amount from 0 to about 30% by weight of the paper substrate; and a surface size layer on at least one of the first and second surfaces, surface size layer comprising:

about 50 lbs or less per ton of the paper substrate of a starch surface sizing agent; and a multivalent metal salt drying agent in an amount sufficient to impart to the at least one of the first and second surfaces a black print density value of at least about 0.8 when inkjet printed with pigmented inks and a waterfastness value of at least about 85% when inkjet printed with dye-based inks;

wherein the printable substrate has a MD tensile strength of at least about 12 lbs/in. and a CD tensile strength of at least about 6 lbs/in.

2. The article of claim 1, wherein the surface size layer is on both the first and second surfaces.

3. The article of claim 1, wherein the multivalent metal salt drying agent comprises calcium chloride.

4. The article of claim 1, wherein the paper substrate has a basis weight of from about 15 to about 25 lbs/1300 $ft^2$.

5. The article of claim 4, wherein the paper substrate has a basis weight of from about 18 to about 20 lbs/1300 $ft^2$.

6. The article of claim 1, wherein the substrate filler comprises from about 10 to about 25% by weight of the paper substrate.

7. The article of claim 6, wherein the substrate filler comprises from about 15 to about 20% by weight of the paper substrate.

8. The article of claim 6, wherein the substrate filler comprises calcium carbonate.

9. The article of claim 6, wherein the paper substrate further comprises a cationic starch binder in amount in the range of from about 0.05 to about 3% by weight of the paper substrate.

10. The article of claim 9, wherein the paper substrate comprises the cationic starch binder in amount in the range of from about 0.1 to about 2% by weight of the paper substrate.

11. The article of claim 1, wherein the surface size layer comprises about 25 lbs or less per ton of the paper substrate of a starch surface sizing agent.

12. The article of claim 11, wherein the surface size layer comprises about 10 lbs or less per ton of the paper substrate of a starch surface sizing agent.

13. The article of claim 12, wherein the surface size layer comprises from about 0.1 to about 10 lbs or less per ton of the paper substrate of a starch surface sizing agent.

14. The article of claim 13, wherein the starch surface sizing agent comprises ethylated starch.

15. The article of claim 1, wherein the opacity value of the printable substrate is at least about 90% and wherein the showthrough value is about 0.13 or less.

16. The article of claim 15, wherein the opacity value of the printable substrate is at least about 92% and wherein the showthrough value is about 0.12 or less.

17. The article of claim 1, wherein the amount of multivalent metal salt drying agent present in surface size layer is sufficient to impart a black print density value of at least about 1.2, and wherein the waterfastness value is at least about 90%.

18. The article of claim 1, wherein the paper substrate comprises about 10 to about 40% by weight softwood fibers and from about 60 to about 90% by weight hardwood fibers.

19. The article of claim 1, wherein the black print density value is at least about 1.0.

20. The article of claim 19, wherein the black print density value is at least about 1.2.

21. The article of claim 1, wherein the printable substrate has a MD tensile strength of from about 25 to about 35 lbs/in. and a CD tensile strength of from about 8 to about 12 lbs/in.

22. The article of claim 1, wherein the paper substrate has an HST value of from about 5 to about 350 seconds.

23. The article of claim 22, wherein the paper substrate has an HST value of from about 10 to about 100 seconds.

24. A method for preparing a printable substrate, which comprises the following steps:

(a) providing a paper substrate having a first surface and a second surface and having a basis weight of from about 12 to about 32 lbs/1300 $ft^2$, the paper substrate comprising:

paper fibers in an amount in the range of from about 60 to 100% by weight of the paper substrate; and a substrate filler in an amount in the range of from 0 to about 30% by weight of the paper substrate; and (b) forming on at least one of the first and second surfaces a surface size layer to provide the printable substrate having a showthrough value of about 0.14 or less, and an opacity value of at least about 88%;

(c) wherein the surface size layer of step (b) comprises about 50 lbs or less per ton of the paper substrate of a starch surface sizing agent;

(d) wherein the surface size layer of step (b) comprises a multivalent metal salt drying agent in an amount sufficient to impart to the at least one of the first and second surfaces a black print density value of at least about 0.8 when inkjet printed with pigmented inks and a waterfastness value of at least about 85% when inkjet printed with dye-based inks;

(e) wherein the printable substrate of step (b) has a MD tensile strength of at least about 12 lbs/in. and a CD tensile strength of at least about 6 lbs/in.

25. The method of claim 24, wherein a surface size layer is formed on both the first and second surfaces during step (b).

26. The method of claim 24, wherein step (b) is carried out by applying a surface size composition comprising the multivalent metal salt drying agent and the optional starch surface sizing agent to at least one of the first and second surfaces with a size press to form the surface size layer.

27. The method claim 24, wherein the size press is a rod metering size press.

28. The method of claim 24, wherein the size press is flooded nip size press.

29. The method of claim 24, wherein the substrate filler comprises from about 10 to about 25% by weight of the paper substrate of step (a).

30. The method of claim 29, wherein the substrate filler comprises from about 15 to about 20% by weight of the paper substrate of step (a).

31. The method of claim 24, wherein the substrate filler of step (a) comprises calcium carbonate.

32. The method of claim 24, wherein the paper substrate of step (a) comprises cationic starch binder in the range of from about 0.05 to about 3% by weight of the paper substrate.

33. The method of claim 32, wherein the paper substrate of step (a) comprises cationic starch binder in the range of from about 0.1 to about 2% by weight of the paper substrate.

34. The method of claim 24, wherein the surface size layer formed during step (b) comprises from about 0.1 to about 10 lbs or less per ton of the paper substrate of a starch surface sizing agent.

35. The method of claim 24, wherein the starch surface sizing agent comprises ethylated starch.

36. The method of claim 24, wherein the paper substrate of step (a) comprises about 10 to about 40% by weight softwood fibers and from about 60 to about 90% by weight hardwood fibers.

* * * * *